US006397747B1

(12) United States Patent
McEachern

(10) Patent No.: US 6,397,747 B1
(45) Date of Patent: Jun. 4, 2002

(54) MAGNETIC CYLINDER FOR PRINTING PLATE WITH NONMAGNETIC SHELL

(75) Inventor: David A. McEachern, St. Paul, MN (US)

(73) Assignee: T. D. Wright, Inc., St. Paul, MN (US)

( * ) Notice: Subject to any disclaimer, the term of this patent is extended or adjusted under 35 U.S.C. 154(b) by 0 days.

(21) Appl. No.: 09/611,305

(22) Filed: Jul. 6, 2000

(51) Int. Cl.[7] ..... B41F 27/02

(52) U.S. Cl. ..... 101/389.1; 101/378; 492/8; 335/306

(58) Field of Search ..... 101/389.1, 415.1, 101/375, 376, 382.1, 378, 383; 492/8, 47, 49, 53, 54; 29/895, 895.21, 895.32; 335/297, 302, 306

(56) References Cited

U.S. PATENT DOCUMENTS 3,721,189 A * 3/1973 Bray ..... 101/415.1
3,897,292 A * 7/1975 Fukuyama ..... 101/389.1
4,625,928 A * 12/1986 Peekna ..... 101/415.1
5,511,476 A * 4/1996 Banike et al. ..... 101/389.1

* cited by examiner

*Primary Examiner*—Leslie J. Evanisko

(57) ABSTRACT

A magnetic cylinder for printing plates and the like has a core of low-cost magnetically permeable material with an outer shell of higher cost low magnetic permeability material with magnetic elements resting in cavities or channels formed in the shell.

11 Claims, 1 Drawing Sheet

MAGNETIC CYLINDER FOR PRINTING PLATE WITH NONMAGNETIC SHELL

FIELD OF THE INVENTION

This invention is in the field of curved magnetic latches or holding devices specifically in the form of a magnetic drum or cylinder for use in holding printing plates or the like. More particularly, the invention is directed toward magnetic cylinders which are formed by placing magnetic elements into channels or recesses or pockets on the outer surface of the cylinder.

DESCRIPTION OF THE PRIOR ART

U.S. Pat. No. 5,627,505 by Iwaszek describes a magnetic cylinder in which magnetic elements comprising a number of bar magnets with intermediate pole pieces in close intimate contact with one another are located in axial extending recesses or slots or pockets or channels formed on the surface of a cylindrical drum to provide the magnetic field for the magnetic cylinder. U.S. Pat. No. 5,898,352 by McEachern, et al. relates to the same type of magnetic drum but introduces a foraminate layer at the bottom of the channel for the dual purpose minimizing air pockets in any adhesive that is used and for serving as a magnetic insulator between the magnetic elements and the cylinder core. Another U.S. Pat. No. 5,938,579 by Cavazos deals with a similar magnetic cylinder which uses nonmagnetic spacers in the channels to serve as magnetic insulators for the magnetic elements located in the channels.

The '505 patent uses a nonmagnetic stainless steel as the material for the cylinder because of its low or nonmagnetic permeability so as to minimize or eliminate magnetic field leakage. The '352 patent uses a foraminous layer at the bottom of the channels to minimize adverse effects of air bubbles in any adhesive and provide some degree of magnetic insulation. The '579 patent utilizes spacers in the channels for magnetic insulation. The '352 patent suggests the possibility of making a cylinder out of less costly magnetically permeable mild or tool steel and the '579 patent cylinder is made out of soft mild steel.

SUMMARY OF THE INVENTION

The present invention is aimed at providing a magnetic cylinder constructed similar to those in the aforementioned U.S. patents in which magnetic elements are placed in channels or recesses on the outer surface of the cylinder. The cylinder is constructed with a core made out of soft mild steel or tool steel which is magnetically permeable with a sleeve or a shell over the outer surface of the core. The sleeve is made out of hard stainless steel or aluminum which has a very low magnetic permeability. The channels or pockets are formed in the shell so that the magnetic elements can be placed in these channels without the need for spacers or other types of magnetic insulating devices. In this fashion then the bulk of the cylinder is made out of the much lower cost mild steel or tool steel and only the shell, which generally constitutes a small volume of the cylinder, is made out of the more costly stainless steel with the resulting advantage of eliminating magnetic field leakage. The savings in eliminating magnetic insulating spacers offsets any cost involved in forming the cylinder out of a shell of stainless steel over a soft steel core. It may also be less costly to machine or otherwise form the recesses in the outer shell or sleeve layer. If aluminum is used there may also be a weight-saving benefit.

DESCRIPTION OF THE PREFERRED EMBODIMENTS

Figure 1:
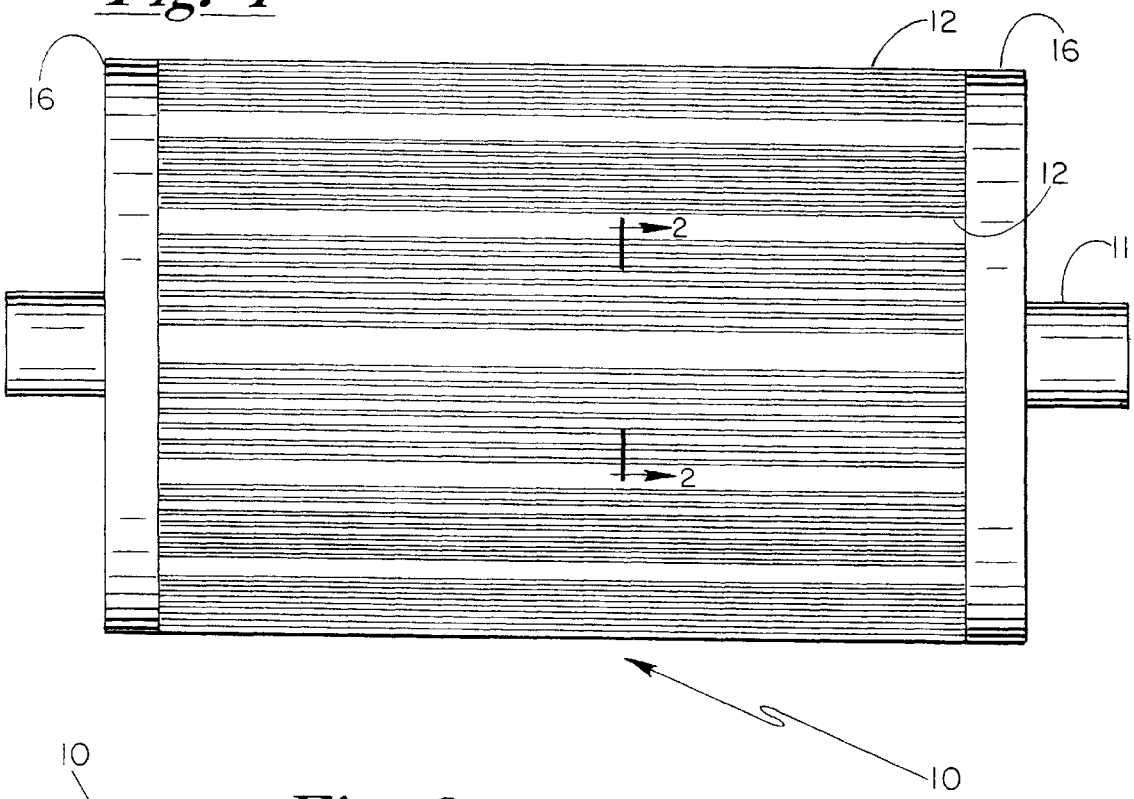
FIG. 1 is a general plan view of a magnetic cylinder constructed according to the teachings of this invention.
Figure 2:
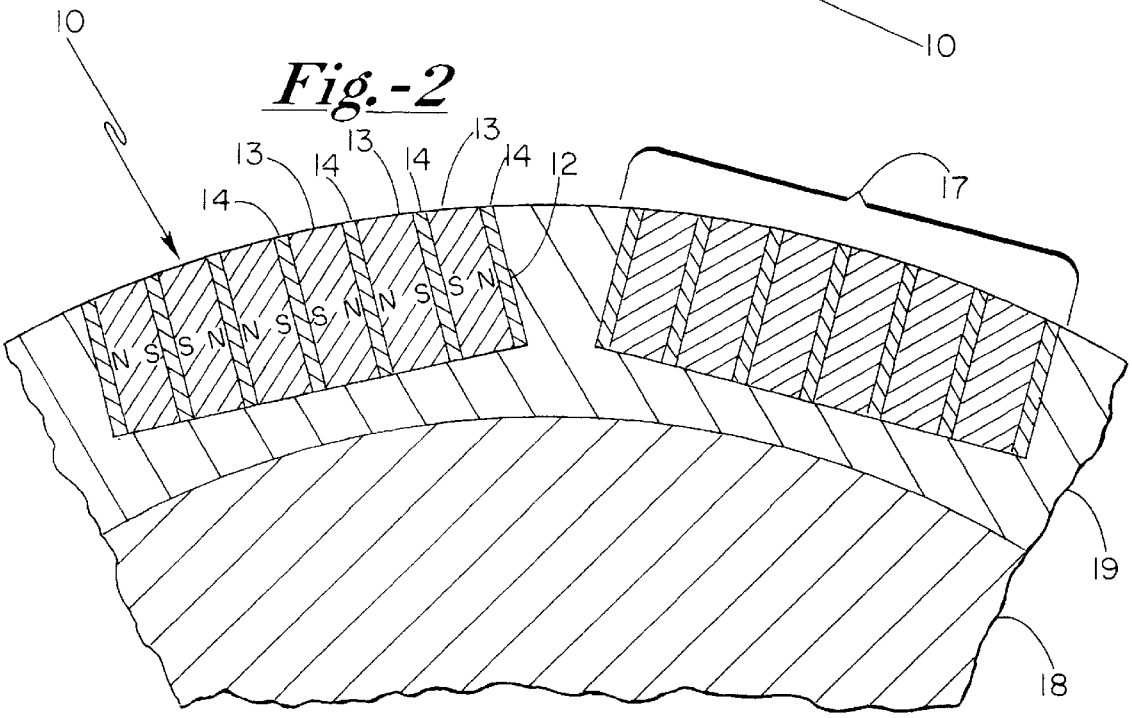
FIG. 2 is an enlarged partial section view of the embodiment illustrated in FIG. 1.

The magnetic cylinder or drum 10 conventionally has an axial shaft 11 which, when mounted in a suitable printing or die-cutting machine, rotatably drives the cylinder on which is mounted a printing plate or die-cutting plate, not shown. Typically and conventionally, a series of axially extending channels or recesses 12 are formed on the outer surface of the cylinder usually by machining. Typically and conventionally, magnetic elements 17 are inserted in channels or recesses 12 and if needed may be held in place within the channels 12 by a suitable adhesive, not shown. Typically, magnetic elements 17 comprise a stack of elongated permanent bar magnets 13 separated circumferentially from one another by pole pieces 14 so that the magnets 13 and the pole pieces 14 make close intimate contact with one another. Bar magnets 13 are magnetized in a general circumferential direction with successive magnets being oppositely polarized. As illustrated in FIG. 2, starting at one side of a recess or channel 12 and going clockwise, a first pole piece 14 has an adjacent first magnet 13 polarized or oriented N-S (North-South) then another pole piece with the next magnet polarized or magnetically oriented S-N followed by another pole piece and then another N-S oriented magnet, et sequential. This then forms alternate North and South magnetic pole pieces to provide the magnetic field for holding a printing plate or die-cutting plate (not shown) when the cylinder is in use. The magnetic elements may also be locked in place by end cap rings 16.

Magnetic printing plate cylinder 10 has an inner or center core 18 and an outer sleeve or shell 19. Typically the outer sleeve is press-fitted onto the core section 18. Preferably the channels or recesses 12 are machined into the sleeve 19 after it has been mounted onto core 18. The core is made out of a relatively low cost soft steel or tool steel which has a high degree of magnetic permeability. The shell or sleeve 19 can be made out of a material having a low magnetic permeability such as 300 Series stainless steel or aluminum so that magnetic field leakage or armaturing through the drum is virtually eliminated. Generally speaking, the material for the shell has a significantly greater unit cost than the unit cost for the soft steel core 18 but this is offset by the elimination of the need for spacers or the like to provide magnetic insulation for the magnetic elements contained in the channels of the sleeve material. Another advantage from a manufacturing viewpoint is that the material used in the sleeve 19 may be easier to machine to form the recesses or channels 12. By making only the sleeve or shell 19 out of the more expensive low permeability material, considerable savings in cost of material are possible without losing any magnetic holding power of the cylinder.

In a typical case of a magnetic cylinder constructed according to the teachings of this invention the core 18 would constitute about 70%–90% of the volume of the cylinder and, correspondingly, the outer shell would constitute about 10%–30%. Where the core material is mild steel and the shell or sleeve material is aluminum the relative prices between the two are in the order of 35 cents–60 cents per pound for the mild or tool steel and in the range of about $1.50–$2.50 per pound for aluminum. The unit price for a shell made out of stainless steel would range somewhere between $3.00 and $5.00 a pound. (Because both aluminum and stainless steel exhibit substantial variations in prices due to market conditions, it is only possible to give fairly broad ranges for the unit prices.) So it is clear that there would be significant savings in material alone by making the cylinder out of a combination of the low priced magnetically permeable soft or mild steel with a sleeve or shell of a much higher priced material having a low degree of magnetic permeability while the cylinder would still retain its strength and durability characteristics necessary for use in the application as a magnetic cylinder for a printing plate.

Aluminum for use as the sleeve or shell is preferable from a material cost. Also, in general, aluminum tubing suitable for press-fitting onto a core of mild steel is usually more available than hollow tubing of stainless steel. In addition, in general it is much easier to machine the channels or recesses in aluminum than it is to machine the same recesses in stainless steel so that manufacturing costs would be further reduced when using aluminum instead of stainless steel although there may be some applications where stainless steel is better or even necessary.

Another advantage of having an outer shell of very low magnetic permeability, whether it be stainless steel or aluminum, is that the channels for receiving the magnetic element can be spaced closer together and more magnetic elements can be inserted into the channels in lieu of spacers such as required in the '579 patent.

I claim:

1. A magnetic cylinder for a printing plate, comprising:

a cylindrical core;

a shell consisting of material having low magnetic permeability fixedly covering the outer surface of said core;

a plurality of channels formed in said shell; and magnetic elements comprising pole pieces and magnets firmly lodged in said channels.

2. A magnetic cylinder as described in claim 1 wherein said core is made of a magnetically permeable material.

3. A magnetic cylinder as described in claim 2 wherein the volume of core material is in the range of about 70%–90% and the volume of shell material is in a corresponding range of about 30%–10%.

4. A magnetic cylinder as described in claim 1 wherein said shell material is aluminum.

5. A method for making a magnetic cylinder for printing plates, comprising the steps of:

a) covering the outer surface of a cylindrical core with a shell consisting of material having low magnetic permeability;

b) forming a plurality of channels in said shell;

c) inserting magnetic elements comprising pole pieces and magnets in said channels.

6. The method for making a magnetic cylinder as described in claim 5 wherein the shell material is aluminum.

7. The method for making a magnetic cylinder as described in claim 5 wherein said core is made of a magnetically permeable material.

8. The method for making a magnetic cylinder as described in claim 7 wherein the volume of core material is in the range of 70%–90% and the volume of shell material is in a corresponding range of 30%–10%.

9. A magnetic cylinder for a printing plate comprising:

a cylindrical core;

a shell consisting of material having low magnetic permeability fixedly covering said core;

plurality of channels formed in said shell, said channels extending parallel to the longitudinal axis of said core and circumferentially spaced from one another; and magnetic elements comprising pole pieces and magnets firmly lodged in each of said channels.

10. A magnetic cylinder as described in claim 9 wherein said channels extend substantially from one end to the other end of said shell.

11. A magnetic cylinder as described in claim 9 wherein said channels have bottom walls resting against said core, said magnetic elements resting directly against said channel bottom walls.

* * * * *